US007478547B2

(12) United States Patent
Okazaki et al.

(10) Patent No.: US 7,478,547 B2
(45) Date of Patent: Jan. 20, 2009

(54) DRUM WASHING MACHINE

(75) Inventors: Yoji Okazaki, Yokohama (JP); Tsuyoshi Hosoito, Seto (JP)

(73) Assignees: Kabushiki Kaisha Toshiba, Tokyo (JP); Toshiba Ha Products Co., Ltd., Osaka-Fu (JP); Toshiba Consumer Marketing Corporation, Tokyo (JP)

( * ) Notice: Subject to any disclaimer, the term of this patent is extended or adjusted under 35 U.S.C. 154(b) by 501 days.

(21) Appl. No.: 10/548,299

(22) PCT Filed: Dec. 26, 2003

(86) PCT No.: PCT/JP03/17088

§ 371 (c)(1),
(2), (4) Date: Sep. 6, 2005

(87) PCT Pub. No.: WO2004/079078

PCT Pub. Date: Sep. 16, 2004

(65) Prior Publication Data

US 2006/0207299 A1 Sep. 21, 2006

(30) Foreign Application Priority Data

Mar. 6, 2003 (JP) ..... 2003-059906

(51) Int. Cl.
*D06F 33/02* (2006.01)

(52) U.S. Cl. ..... 68/12.04; 68/12.06; 68/12.16; 68/24

(58) Field of Classification Search ..... 68/12.02, 68/12.04, 12.06, 12.16, 12.23, 24
See application file for complete search history.

(56) References Cited

U.S. PATENT DOCUMENTS 4,607,408 A 8/1986 Didier et al.
5,507,055 A 4/1996 Blauert et al.
5,577,283 A * 11/1996 Badami et al. ..... 8/158

(Continued)

FOREIGN PATENT DOCUMENTS

DE 19857903 A 6/1999

(Continued)

OTHER PUBLICATIONS

Japanese Office Action and translation thereof with relevance to Japanese Patent Application No. 2003-059906.

*Primary Examiner*—Joseph L Perrin
(74) *Attorney, Agent, or Firm*—Pillsbury Winthrop Shaw Pittman, LLP

(57) ABSTRACT

A drum washing machine including a cylindrical drum, a DC brushless motor directly connected to the drum, a current detector detecting current flowing through the motor, a torque control vector-controlling the motor on the basis of the current detected by the current detector so that motor torque becomes optimum at least in a wash or dehydration operation, and a laundry weight estimator accelerating the motor with a maximum output torque developed when determining that motor speed is between a first speed at which laundry is assumed to start falling from an uppermost part of inner periphery of the drum when motor speed is reduced from a high speed side and a second speed at which laundry is assumed to start sticking to an uppermost part of the inner periphery of the drum, estimating laundry weight according to a q-axis current value in the vector control during an accelerating period.

17 Claims, 15 Drawing Sheets

U.S. PATENT DOCUMENTS

| | | | | |
|---|---|---|---|---|
| 5,677,606 | A | 10/1997 | Otake | |
| 6,029,300 | A * | 2/2000 | Kawaguchi et al. | 8/159 |
| 6,163,912 | A * | 12/2000 | Matsuura et al. | 8/159 |
| 6,341,507 | B1 * | 1/2002 | Rode et al. | 68/12.16 |
| 6,495,980 | B2 * | 12/2002 | Cho et al. | 318/400.02 |
| 6,842,928 | B2 * | 1/2005 | Yang et al. | 8/159 |
| 2002/0050011 | A1 * | 5/2002 | Cho et al. | 8/159 |
| 2002/0189301 | A1 * | 12/2002 | Hosoito et al. | 68/12.02 |

FOREIGN PATENT DOCUMENTS

| | | | |
|---|---|---|---|
| EP | 0159202 | A | 10/1985 |
| EP | 0903845 | A2 | 3/1999 |
| EP | 1265351 | A | 12/2002 |
| JP | 06-000275 | | 1/1994 |
| JP | 09-051700 | A | 2/1997 |
| JP | 11-090088 | A | 4/1999 |
| JP | 11-319367 | A | 11/1999 |
| JP | 2001-178992 | | 7/2001 |
| JP | 2001-276469 | A | 10/2001 |
| JP | 2001-347097 | A | 12/2001 |
| JP | 2002-212788 | | 7/2002 |
| JP | 2002252995 | | 9/2002 |
| JP | 2002-360970 | A | 12/2002 |
| WO | WO9836123 | A2 * | 8/1998 |

* cited by examiner

EFFECTIVE q-AXIS CURRENT VALUE

EFFECTIVE d-AXIS CURRENT VALUE $$y = -13.70780694x^2 + 112.5122816x - 242.8221477 - 0.5916270169z^2 + 7.546078222z$$

$\mu_{40}=3.363$ $\mu_{50}=3.402$
$\sigma_{40}=0.0167$ $\sigma_{50}=0.0165$ $3\sigma_0=0.05$ $\mu_{41}=3.353$ $\mu_{51}=3.383$
$\sigma_{41}=0.004$ $\sigma_{51}=0.004$ $3\sigma_1=0.012$

VARIATION IS DECREASED TO OR BELOW ONE FOURTH, WHEREBY ACCURACY IS IMPROVED

DRUM WASHING MACHINE

This is the U.S. National Stage of International Application No. PCT/JP2003/017088, filed on Dec. 26, 2003, which relies for priority upon Japanese Patent Application No. JP 2003-059906, filed Mar. 6, 2003, the contents of both of which are incorporated herein by reference in their entireties.

TECHNICAL FIELD

The present invention relates to a drum washing machine in which a vector control is carried out for the control of output torque of an electric motor rotating a drum.

BACKGROUND ART

In conventional drum washing machines, a rotational speed of a drum is increased to a predetermined first value in determination of the weight of laundry in a drum and is further increased from the predetermined value to another second higher speed. The laundry weight is determined on the basis of the length of time length required for the rotational speed to be increased from the first value to the second value. However, when the rotational speed of the drum is in a higher range, windage loss occurs, or friction produced between an access cover of the drum in a stationary state and cloth is increased. As a result, it is difficult to obtain the detection results in proportional to the difference in laundry weight. Thus, the accuracy in the detection is reduced.

Furthermore, JP-6-275-A discloses a vector control controlling an output torque of an electric motor in a top loading type washing machine. A laundry weight is determined on the basis of a q-axis current value in the vector control. More specifically, since the q-axis current in the vector control is proportional to the output torque of the motor, the state of a load driven by the motor can be estimated properly by referring to the q-axis current value. Accordingly, the accuracy in the determination of laundry weight can be improved when the laundry weight is determined on the basis of the q-axis current value.

However, the technique disclosed by JP-6-275-A is applied to a top loading type washing machine in which an agitator mounted on the bottom of a wash tub is rotated. Thus, the disclosed technique cannot directly be applied to a drum washing machine. Furthermore, in order that an accurate laundry weight may be determined, it is ideal that laundry should be distributed uniformly in the drum so as to be well balanced. However, the above-noted publication discloses nothing in this respect, and further, the drum washing machine differs from the top loading type washing machine in the basic structure and accordingly, in the balancing system. As a result, the technique disclosed by JP-6-275-A cannot be applied directly to the drum washing machine.

Therefore, an object of the present invention is to provide a drum washing machine in which the laundry weight can be estimated with higher accuracy.

SUMMARY OF THE INVENTION

The drum washing machine of the present invention comprises a cylindrical drum including a front portion formed with an access opening through which laundry is put thereinto, the drum having a substantially horizontal axis of rotation, a DC brushless motor having a rotational shaft directly connected to a rear of the drum having a substantially horizontal axis of rotation, current detecting means for detecting an electric current flowing through the motor, torque controlling means for vector-controlling the motor on the basis of the current detected by the current detecting means so that torque developed by the motor becomes optimum at least in each of a wash operation and a dehydration operation, and laundry weight estimating means accelerating the motor with a maximum output torque developed when determining that a rotational speed of the motor is between a first rotational speed at which the laundry is assumed to start falling from an uppermost part of an inner periphery of the drum when the rotational speed of the motor is r-educed from a high speed side and a second rotational speed at which the laundry in the drum is assumed to start sticking to an uppermost part of the inner periphery of the drum, thereby estimating a laundry weight according to a q-axis current value in the vector-control during an accelerating period.

Laundry falls downward from the inner peripheral face of the drum when the drum is rotated at a relatively low speed in the drum washing machine, whereupon the location of laundry is easy to change. Accordingly, the laundry can be balanced to some degree even when the drum is merely rotated at a relatively low speed. In this state, when the rotational speed of the drum is increased, a centrifugal force acts on the laundry such that the laundry tends to stick to the inner periphery of the drum. When the rotational speed of the drum is further increased, the drum is rotated while the laundry is kept sticking to the inner periphery of the drum.

On the other hand, when the rotational speed of the drum is decreased in the state where the laundry is sticking to the inner periphery of the drum, the centrifugal force acting on the laundry is also decreased and in due course of time, the laundry falls from the uppermost part of the inner periphery of the drum.

In the foregoing process, the laundry is considered to be distributed uniformly to some degree when the rotational speed of the drum is between a critical rotational speed (a second rotational speed) at which the laundry is assumed not to fall downward even when located at the uppermost part of the inner periphery of the drum and starts to stick to the inner periphery of the drum and another critical rotational speed (a first rotational speed) at which the laundry sticking to the inner periphery of the drum is assumed to start falling downward when located at the uppermost part of the inner periphery of the drum. These two critical speeds do not always agree to each other. Accordingly, a q-axis current value detected during the subsequent rapid acceleration of the drum for speed increase shows an amount of load against the motor or a laundry weight more correctly, whereupon the laundry weight can be estimated with high accuracy.

In a preferred form, the laundry weight estimator carries out a balancing control in which the laundry weight estimating means detects variations in the q-axis current value in the vector control when the rotational speed of the motor is between the first and second rotational speeds. In this case, the laundry weight estimator starts acceleration of the motor when a variation level is reduced to or below a predetermined value.

As described above, laundry needs to be balanced in the drum in order that the laundry weight may be estimated with high accuracy. Since the q-axis current value in the vector control directly indicates variations in the load torque of the motor, laundry can be balanced in a more active manner when the variations in the q-axis current value are controlled so as to be rendered smaller.

BEST MODE FOR CARRYING OUT THE INVENTION

First Embodiment

Figure 1:
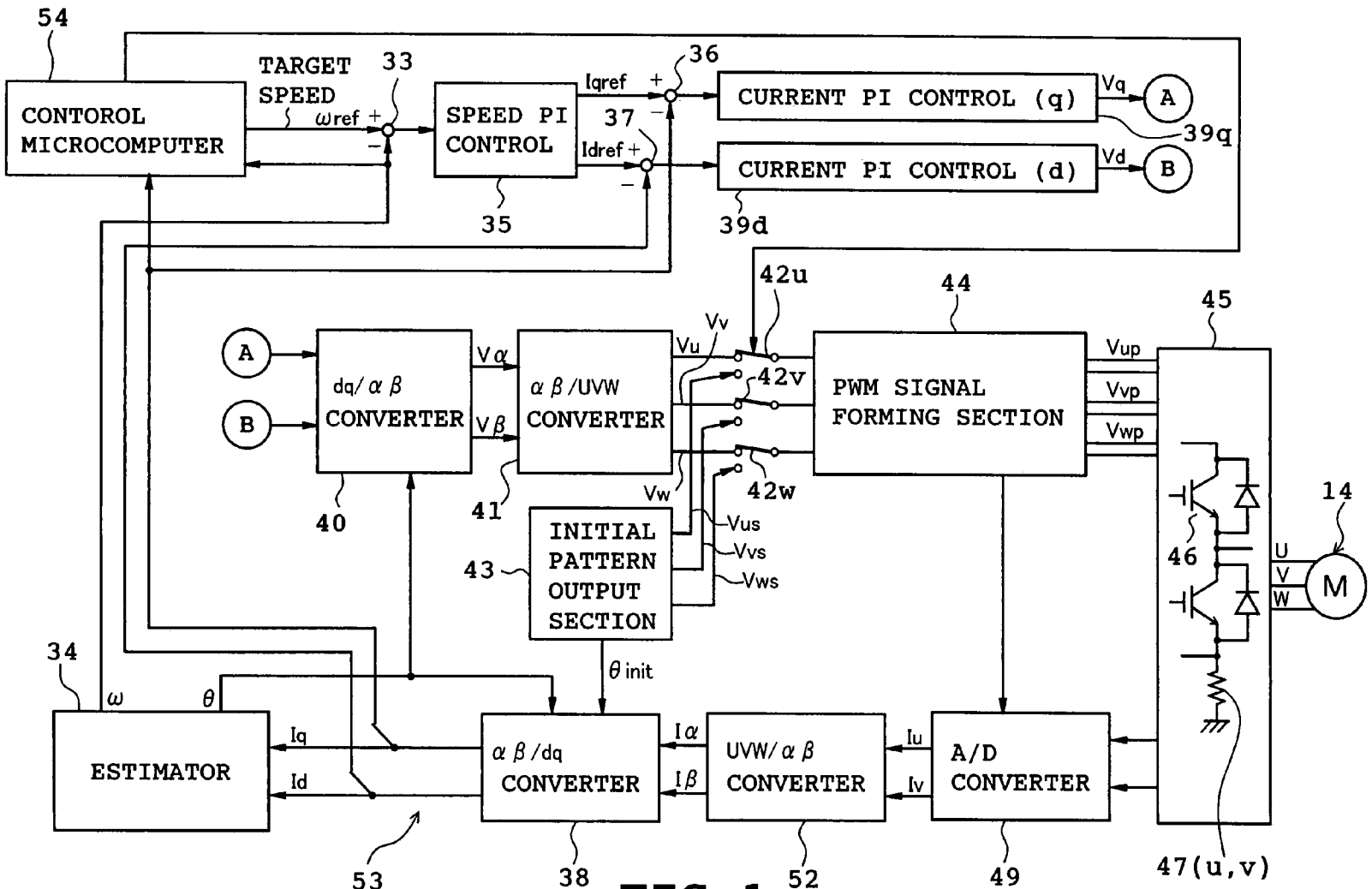
FIG. 1 is a block diagram showing an electrical arrangement of the control system employed in the drum washing machine in accordance with a first embodiment of the present invention.

A first embodiment of the present invention will be described with reference to FIGS. 1 to 9. Referring to FIG. 2, an overall construction of the drum washing machine is shown. The drum washing machine comprises an outer cabinet 1 serving as an outer shell of the drum washing machine. The outer cabinet 1 is provided with a door 2 mounted on the central front thereof and an operation panel 3 mounted on the upper front thereof. The operation panel 3 includes a number of switches and display sections none of which are shown. The door 2 closes and opens an access opening 4 formed in the central front of the outer cabinet 1. Laundry is put into and taken out of a drum 7 through the access opening 4.

A cylindrical water tub 5 is disposed in the outer cabinet 1. The water tub 5 has an axis extending substantially horizontally in the back-and-forth direction so that a rear portion thereof is inclined downward. The water tub 5 is elastically supported by elastically supporting means 6. The drum 7 is disposed in the water tub 5 so as to be coaxial with the latter and serves as wash, dehydration and drying tubs. The drum 7 has a number of small holes 8 formed in an overall area of the body thereof. Some of the holes 8 are shown in FIG. 2. A plurality of baffles 9 are mounted on an inner periphery of the body of the drum 7. Only one of the baffles 9 is shown in FIG. 2. The water tub 5 and the drum 7 have access openings 10 and 11 formed in the front portions respectively. The opening 10 of the water tub 5 is connected by bellows 12 to the access opening 4 of the outer cabinet 4 in a watertight manner. The opening 11 of the drum 7 faces the opening 10 of the water tub 5. A balancing ring 13 is attached to a periphery of the opening 11.

An electric motor 14 for rotating the drum 7 comprises a DC brushless motor of the outer rotor type. The motor 14 is mounted on the rear of the water tub 5. The motor 14 includes a stator 15 mounted on an outer periphery of a bearing housing 16 further mounted on the central rear of the water tub 5. A rotor 17 of the motor 14 is disposed so as to cover the stator 15 from outside. A rotational shaft 18 is mounted on the center of the rotor 17 and supported via bearings 19 on the bearing housing 16 so as to be rotatable. The rotational shaft 18 has a front end projecting out of the bearing housing 16 and connected to the central rear of the drum 7. Consequently, the drum 7 is rotated together with the rotor 17 upon rotation of the latter.

A water reservoir 20 is formed on the underside of the water tub 5. The water reservoir 20 encloses a heater 21 for heating wash liquid. A drain hose 23 is connected via a drain valve 22 to the rear of the water reservoir 20. A hot air generator 24 is mounted on the top of the water tub 5. A heat exchanger 25 is mounted on the rear of the water tub 5. The hot air generator 24 comprises a hot air heater 27 disposed in a case 26, a fan 29 disposed in a casing 28 and a fan motor 31 driving the fan 29 via a belt transmission mechanism 30. The case 26 and the casing 28 communicate with each other. A duct 32 is connected to the front of the case 26 and has a distal end extending into the front interior of the water tub 5 and facing the opening 12 of the drum 7. Hot air is generated by the heater 27 and the fan 29 and supplied through the duct 32 into the drum 7. The hot air supplied into the drum 7 heats laundry and absorbs moisture, being then discharged to the heat exchanger 25 side.

The heat exchanger 25 includes an upper portion communicating with the interior of the casing 28 and a lower portion communicating with the interior of the water tub 5. The heat exchanger 25 is constructed into a water-cooling type in which water poured from the upper portion thereof flows downward so that moisture contained in the air flowing therethrough is cooled to be condensed, whereby the air is dehumidified. The air having passed through the heat exchanger 25 is returned to the hot air generator 24 again thereby to be changed into hot air and recirculated.

Figure 2:
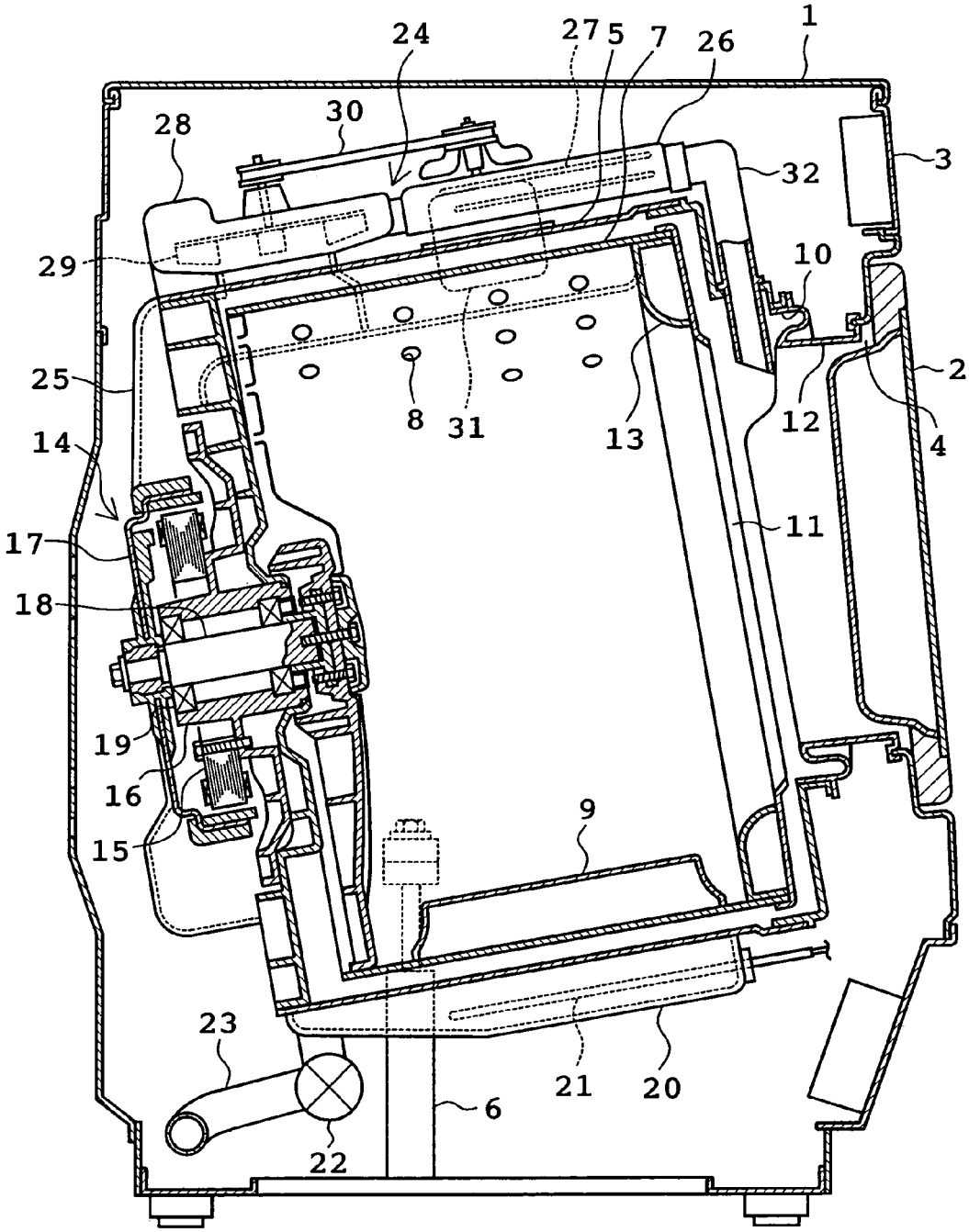
FIG. 2 is a longitudinal side section of the drum washing machine.

FIG. 1 is a block diagram showing an electrical arrangement of the control system employed in the drum washing machine. The shown arrangement is similar to that described in Japanese patent application No. 2002-212788 and accordingly, the arrangement will be described briefly here. A control microcomputer (laundry weight estimator) 54 controlling an overall operation of the washing machine delivers a target speed command $\omega_{ref}$. A subtracter 33 carries out a subtraction between the target speed command $\omega_{ref}$ and a rotational speed $\omega$ of the motor 14 detected by the estimator 34, delivering the result of the subtraction.

A speed PI (proportional-integral) control 35 carries out a PI control on the basis of the difference between the target speed command $\omega_{ref}$ and the detected speed $\omega$, thereby generating a q-axis current command value $I_{qref}$ and a d-axis current command value $I_{dref}$. Subtracters 36 and 37 carry out subtraction between the command values $I_{qref}$ and $I_{dref}$ and q-axis and d-axis current values $I_q$ and Id delivered by an $\alpha\beta$/dq converter, thereby delivering the results of subtraction to current PI controls 39*q* and 39*d*, respectively. The q-axis current value $I_q$ is also supplied to the microcomputer 54.

The current PI controls 39*q* and 39*d* carry out the PI control on the basis of the difference between the q-axis and d-axis current command values $I_{qref}$ and $I_{dref}$, thereby generating and delivering q-axis and d-axis voltage command values $V_q$ and $V_d$. A dq/αβ converter 40 converts the voltage command values $V_q$ and $V_d$ to voltage command values $V_\alpha$ and $V_\beta$ on the basis of a rotation phase angle (rotor position angle) θ of the secondary magnetic flux of the motor 14 detected by the estimator 34.

An αβ/UVW converter 41 converts the voltage command values $V_\alpha$ and $V_\beta$ to three-phase voltage command values $V_u$, $V_v$ and $V_w$, delivering the three-phase voltage command values. Three change-over switches 42*u*, 42*v* and 42*w* change over the three-phase voltage command values $V_u$, $V_v$ and $V_w$ and starting voltage command values $V_{us}$, $V_{vs}$ and $V_{ws}$ delivered by an initial pattern output section 43.

A PWM signal forming section 44 delivers three-phase PWM signals $V_{up}(+,-)$, $V_{vp}(+,-)$ and $V_{wp}(+,-)$ obtained by modulating a carrier wave of 16 kHz on the basis of the voltage command values $V_{us}$, $V_{vs}$ and $V_{ws}$ respectively. An inverter circuit 45 includes six IGBTs 46 connected into a three-phase bridge configuration. Lower arm side phase U and V IGBTs 46 have emitters grounded via current-detecting shunt resistors (current detecting means) 47 (u, v) respectively. Common nodes of these IGBTs 46 are connected via respective amplifier-bias circuits (not shown) to an A/D converter 49. A DC voltage of about 280 V is applied to the inverter circuit 45. The DC voltage is obtained by rectifying voltage of 100 V from an AC power supply by a voltage-doubler full-wave rectifier (not shown). The amplifier-bias circuits amplify terminal voltage of the shunt resistors 47 and bias the amplified voltage so that resultant amplified signals each range in the positive side.

An A/D converter 49 delivers current data $I_u$ and $I_v$ obtained by A/D-converting the output signals of the amplifier-bias circuits. A UVW/αβ converter 52 estimates phase W current data $I_w$ from the current data $I_u$ and $I_v$, converting three-phase current data $I_u$, $I_v$ and $I_w$ into biaxial current data $I_\alpha$ and $I_\beta$ of the orthogonal coordinates system.

An αβ/dq converter 38 obtains a positional angle θ of the motor rotor from the estimator 34 during the vector control to convert the biaxial current data $I_\alpha$ and $I_\beta$ to d-axis current value Id and q-axis current value $I_q$, delivering the values at the intervals of 128 μsec., for example. The estimator 34 estimates the position angle θ and the rotational speed ω of the rotor 17 on the basis of the d-axis and q-axis current values $I_d$ and $I_q$, delivering the estimated position angle θ and the rotational speed ω to the related sections.

The foregoing arrangement except for the inverter circuit 45 is mainly realized by software of DSP (digital signal processor) 53 serving as a torque controller.

Figure 3:
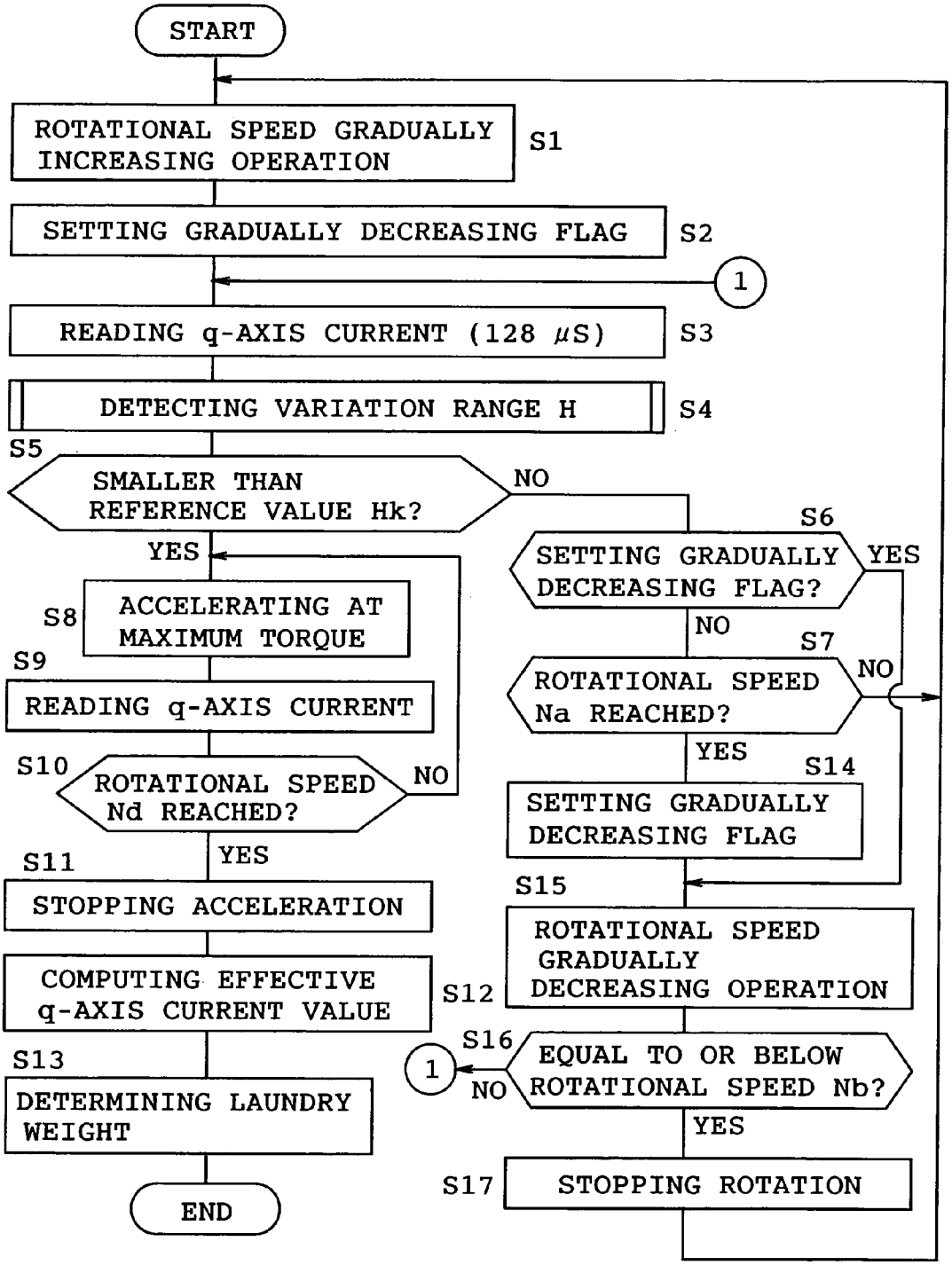
FIG. 3 is a flowchart showing the control contents.

The operation of the drum washing machine will be described with further reference to FIGS. 3 to 9. FIG. 3 is a flowchart of the control contents executed by the control microcomputer 54, showing a process of estimating the weight of laundry put into the drum 7. The control microcomputer 54 carries out a rotational speed gradually increasing operation for the motor 14 at step S1. More specifically, the rotational speed is gradually increased at an acceleration of $(N_a/T_{k1})$ so that an upper reference speed (first rotational speed) $N_a$ is reached for a time period $T_{k1}$. A centrifugal force causes laundry to start sticking to the uppermost point on the inner peripheral face of the drum 7 when the upper reference speed $N_a$ is reached. The upper reference speed $N_a$ is set to be equal to or higher than 40 rpm. In the embodiment, the upper reference speed $N_a$ is set at 75 rpm, for example.

The vector control is carried out for the motor 14 in the rotational speed gradually increasing operation. Since the αβ/dq converter 38 delivers the q-axis current value at intervals of 128 μsec., the rotational speed control is carried out at intervals of 128 μsec. during one turn of the drum 7 (75 to 55 rpm; and 0.8 to 1.09 sec. per turn). Consequently, the motor is controlled so that the rotational variation during one turn of the drum 17 is reduced. More specifically, when the drum 7 is rotated at relatively low speeds in the drum washing machine, the gravity causes laundry to fall downward from the inner peripheral face of the drum 17, whereupon the position of laundry tends to change to a large degree. Thus, the laundry can be balanced to some degree even when merely rotated at relatively low speeds. This is described in detail in Japanese patent application No. 2002-212788, for example.

A gradual decrease flag which will be described in detail later is reset at step S2. The q-axis current Iq is read at intervals of 128 μsec. A variation range H of the q-axis current is detected at step S4.

Figure 4:
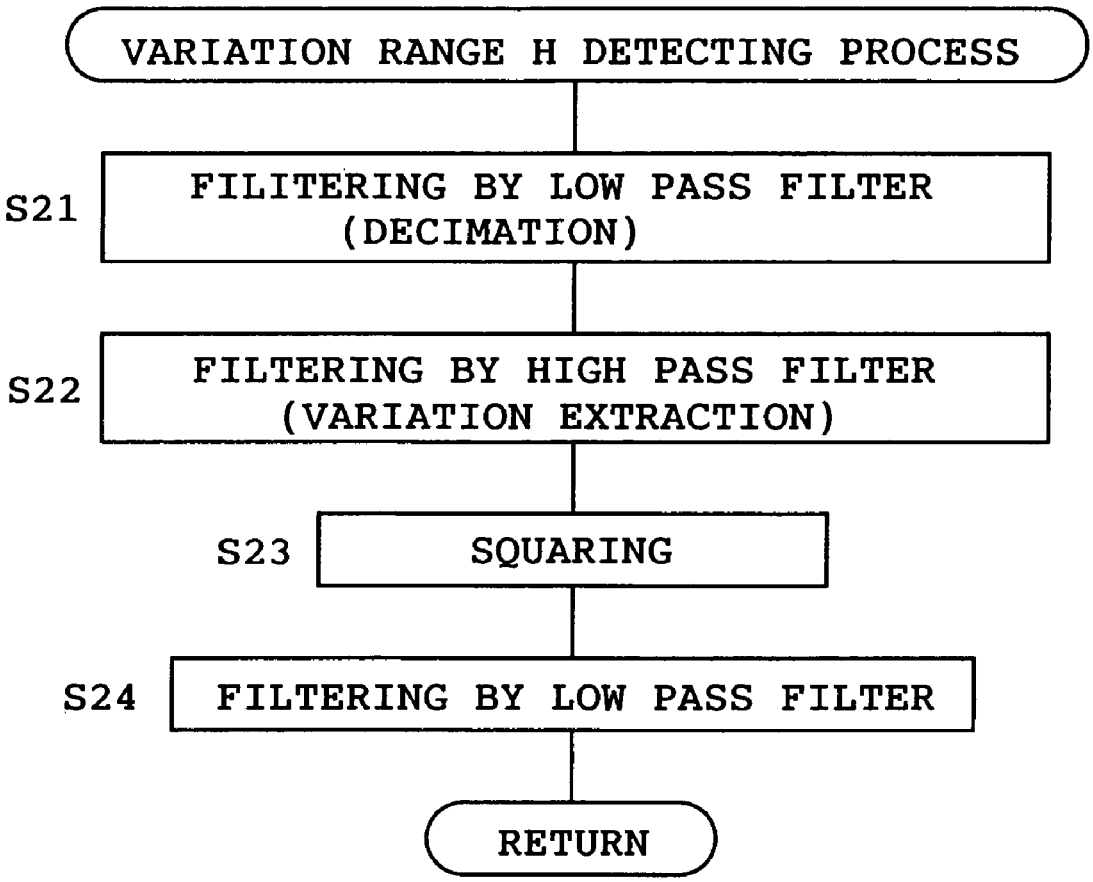
FIG. 4 is a flowchart showing the processing to detect a range of variation of the q-axis current at step S4 in FIG. 3.
Figure 6A:
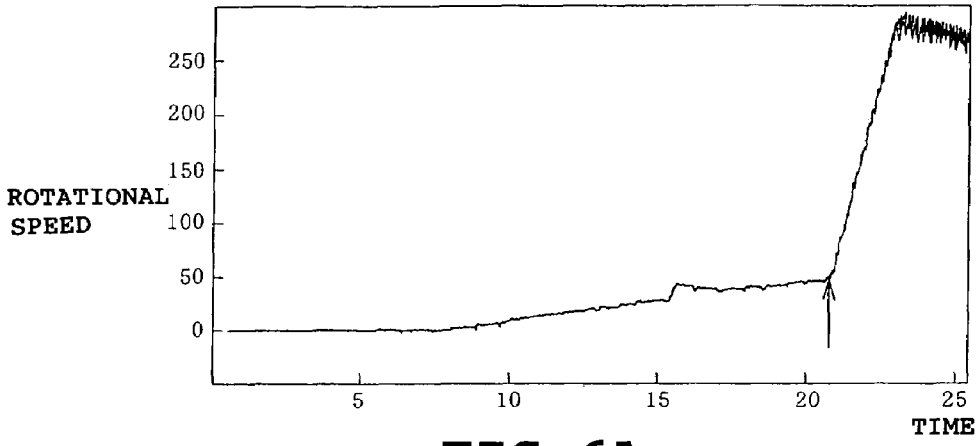
FIGS. 6A, 6B and 6C are graphs showing rotational speeds of the motor measured in the case of process as shown in FIG. 3, sampled values of the q-axis current detected in the state of FIG. 6A, and results obtained by processing the q-axis current values as shown in FIG. 6B, respectively.
Figure 6B:
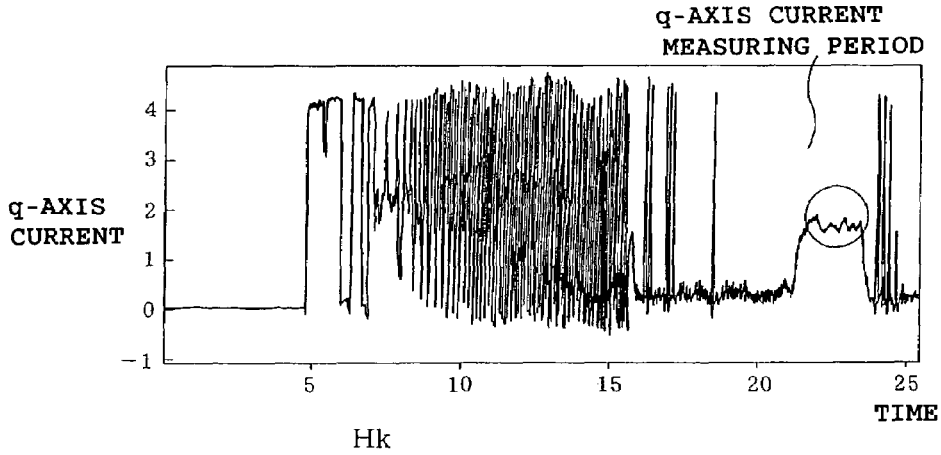
Figure 6C:
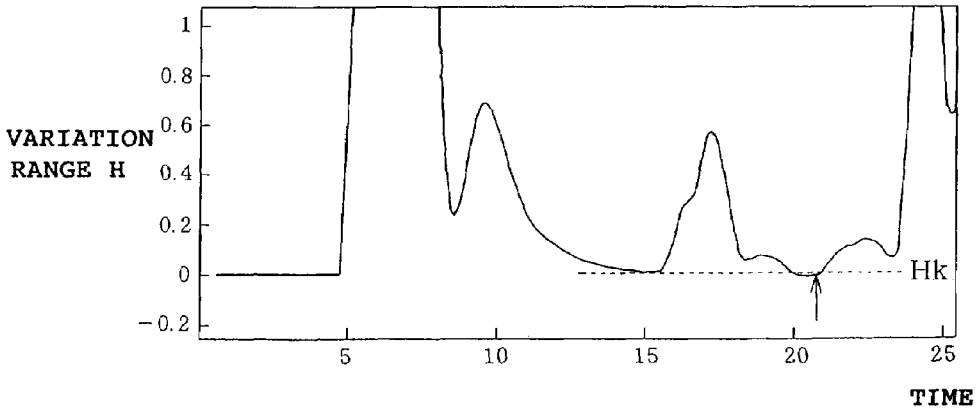

FIG. 4 is a flowchart showing the processing to detect a range of variation of the q-axis current. FIG. 6A shows rotational speeds of the motor 14 in the case where the processing in the flowchart of FIG. 3 has been executed. FIG. 6B shows sampled values of the q-axis current detected in the processing in FIG. 6A. FIG. 6C shows the variation range H obtained by processing the q-axis current value in FIG. 6B according to the flowchart of FIG. 4 which will be described later.

Detection of the variation range H of the q-axis current value at step S4 will now be described with reference to FIG. 4. Firstly, regarding the q-axis current value detected as shown in FIG. 6B, high frequency components are cut off by a digital operation employing a low-pass filter (not shown). Further, the detected values are thinned at a predetermined thinning rate (step S21). Subsequently, variation components are extracted by a high-pass filter which is not shown (step S22). The result of extraction is squared (step S3) and high frequency components are eliminated from the result of squaring (step S24). Consequently, data as shown in FIG. 6C is obtained. The data serves as the variation range H of the q-axis current.

Returning to FIG. 3, whether the variation range H is smaller than a predetermined reference value $H_k$ is determined at step S5. More specifically, the variation range H of the q-axis current represents variations in the load torque of the motor 14. Accordingly, the rotational variation of the drum 7 is large and accordingly a degree of imbalance of the laundry is high when the variation range H is large.

When determining at step S5 that the variation range H is equal to or larger than the reference value $H_k$ (NO), the control microcomputer 54 advances to steps S6 and S7. When the gradual decrease flag is not set (NO at step S6) and the rotational speed has not reached the upper reference speed $N_a$ (NO at step S7), the control microcomputer 54 returns to step S1 to continue the gradual increase of the rotational speed.

When the variation range H is reduced below the reference value $H_k$ before the rotational speed reaches the upper reference speed $N_a$ while carrying out the loop of steps S1 to S7 (YES at step S5), the control microcomputer 54 accelerates the motor 14 at maximum torque (step S8). In this accelerating period, too, the control microcomputer 54 reads the q-axis current $I_q$ at intervals of 128 μsec. (step S9).

The control microcomputer 54 repeats the processing at steps S8 and S9 until the rotational speed of the motor 14 reaches $N_d$ (300 rpm, for example) as the result of acceleration (NO at step S10). When the speed has reached $N_d$ (YES at step S10), acceleration of the motor 14 is stopped (step S1). Subsequently, the control microcomputer 54 computes an effective value (square root of squared mean value) with respect to the q-axis current values $I_q$ sampled during the acceleration period (step S12). The control microcomputer 54 then determines a laundry weight according to the result of computation (step S13).

Figure 5:
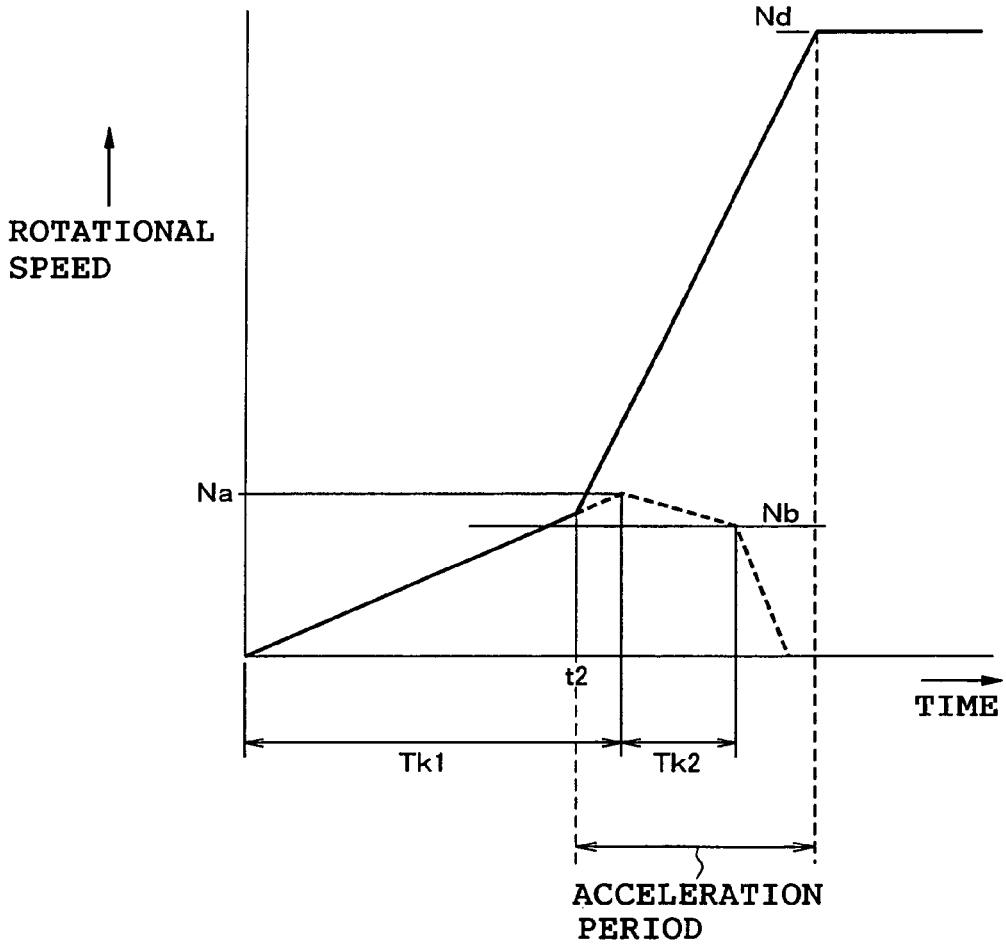
FIG. 5 is a graph showing an example of rotational speed change of the motor according to the control as shown in FIG. 3.

On the other hand, the control microcomputer 54 sets the gradual decrease flag in a flag storage region of an internal memory (step S14) when the variation range H is not reduced below the reference value $H_k$ before the rotational speed reaches the upper reference speed Na while carrying out the loop of steps S1 to S7 (YES at step S7). The control microcomputer 54 then carries out a rotational speed gradually decreasing operation for the motor 14 (step S15). More specifically, as shown in FIG. 5, the rotational speed is gradually decreased at a reduction rate of $(N_a-N_b/T_{k2})$ so that the motor speed is decreased to a lower reference speed (first rotational speed) $N_b$ for a time period $T_{k2}$. It is assumed that laundry starts falling from the uppermost part of the inner peripheral face of the drum 7 when the motor is at the lower reference speed $N_b$. During the rotational speed gradually decreasing operation (NO at step S16), too, the control microcomputer 54 carries out steps S3 to S5 as in the rotational speed gradually increasing operation. When the variation range H becomes below the reference value $H_k$ during the rotational speed gradually decreasing operation (YES at step S5), the control microcomputer 54 carries out step S8 and subsequent steps. Further, when determining in the negative (NO) at step S5, the control microcomputer advances to step S6 to determine in the affirmative since the gradual decrease flag is set, thereafter advancing to step S15.

When the rotational speed gradually decreasing operation is further continued and the motor speed has reached the lower reference speed $N_d$ (YES at step S16) before determination is made in the affirmative at step S5, the control microcomputer 54 once stops rotation of the motor 14 (step S17) and then advances to step S1 to re-execute the rotational speed gradually decreasing operation.

Figure 7:
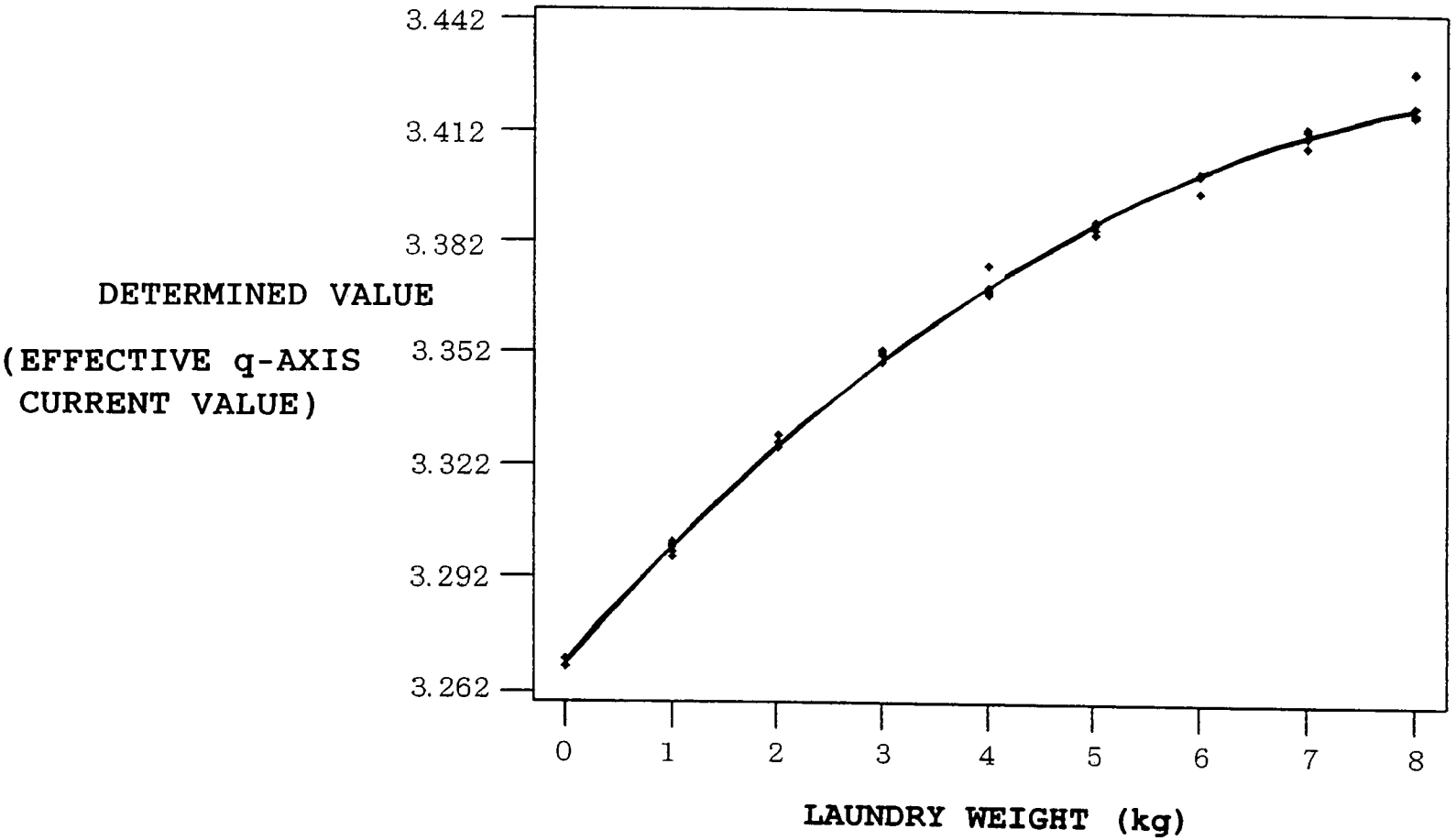
FIG. 7 is a graph showing the relationship between an effective q-axis current value and laundry weight.

In FIG. 7, an axis of ordinates represents an effective q-axis current value and an axis of abscissas represents a laundry weight determined on the basis of the effective q-axis current value. For example, the laundry weight is determined to be about 3 kg when the q-axis current value is 3,352.

In the above-described embodiment, the control microcomputer 54 controls the inverter circuit 45 to drive the motor 14 in the vector control system. The control microcomputer 54 detects variations in the q-axis current value in the vector control when the rotational speed of the motor 14 is between the lower and upper reference speeds $N_b$ and $N_a$. The motor 14 is accelerated at the maximum torque when the variation level is reduced to or below the predetermined value. The laundry weight is estimated according to the q-axis current value in the vector control during the acceleration period. More specifically, when the rotational speed of the motor 14 is between the lower and upper reference speeds $N_b$ and $N_a$, it is assumed that laundry is balanced in the drum 7 to a certain degree. Further, since the q-axis current value in the vector control directly represents the variation in the load torque of the motor 14, the motor 14 is controlled so that the variation in the q-axis current is rendered smaller, whereupon balancing can be carried out in a more active manner.

Under the condition where laundry is assumed to be balanced, the q-axis current is detected while the rotational speed is being increased by rapid acceleration of the drum 7. Since the q-axis current detected in this manner represents an amount of load of the motor 14 or the laundry weight more correctly, the laundry weight can be estimated more accurately.

Furthermore, the control microcomputer 54 carries out the balancing control until the rotational speed of the drum 7 is firstly increased from zero to the upper reference speed $N_a$. Accordingly, the laundry weight can be estimated in a relatively short period of time when the balancing has been carried out smoothly. Additionally, since the balancing control is based on the effective q-axis current value, the control microcomputer 54 can estimate the laundry weight more correctly on the basis of the alternatingly changing q-axis current.

Second Embodiment

Figure 8:
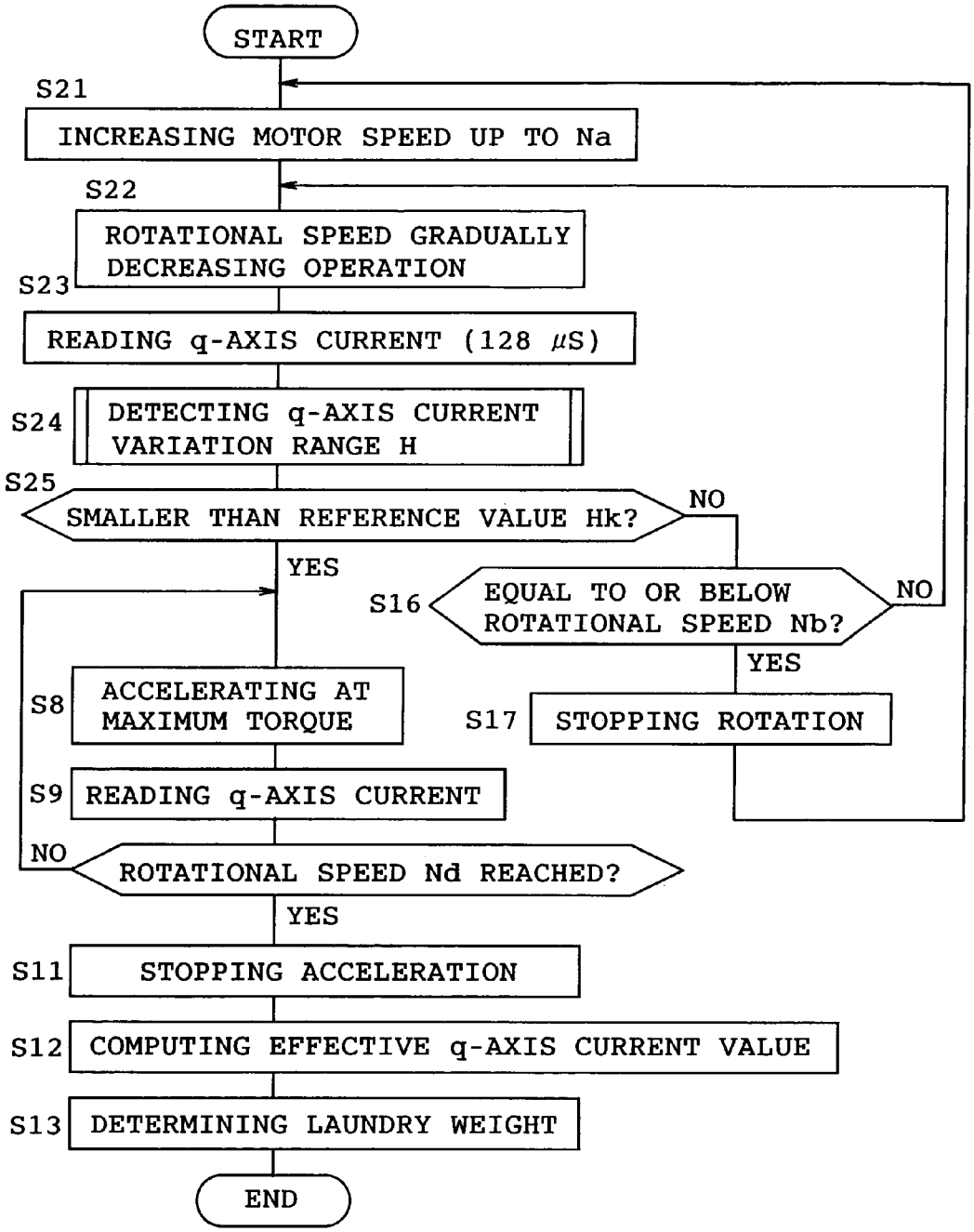
FIG. 8 is a view similar to FIG. 3, showing a second embodiment of the invention.
Figure 9:
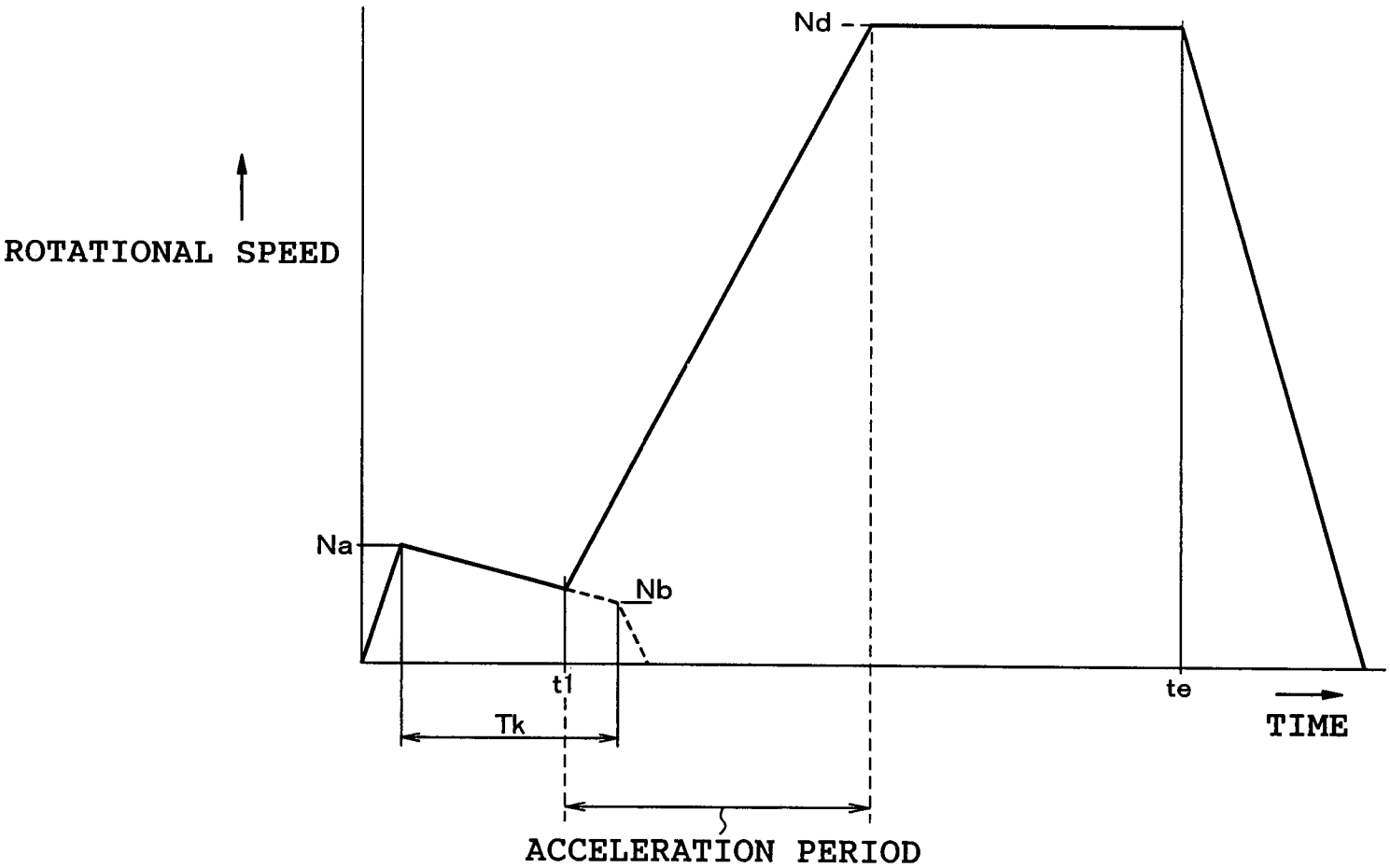
FIG. 9 is a view similar to FIG. 5, showing the second embodiment.

FIGS. 8 and 9 illustrate a second embodiment of the invention. Identical or similar parts in the second embodiment are labeled by the same reference symbols as those in the first embodiment. Only the difference of the second embodiment from the first embodiment will be described in the following. The arrangement of the second embodiment is basically the same as that of the first embodiment, but the software contents for the control microcomputer in the second embodiment differ from those in the first embodiment.

In the second embodiment, the rotational speed of the drum 7 is once increased to the upper reference speed $N_a$ (step S21) and thereafter, the rotational speed is gradually decreased toward the lower reference speed $N_b$ (maximum period $T_k$) (step S22). Subsequently, steps S3 to S5 and S8 to S13 are executed in the same manner as in the first embodiment. Further, when determining in the negative (NO) at step S5, the control microcomputer 54 carries out steps S16 and S17. When determining in the negative (NO) at step S16, the control microcomputer 54 advances to step S22. The control microcomputer 54 advances to step S21 after having executed step S17.

In the second embodiment, the control microcomputer 54 once increases and then decreases the rotational speed of the drum 7. The balancing control is carried out until the lower reference speed $N_b$ is reached. The motor 14 is accelerated at maximum torque when the variation in the q-axis current becomes smaller than the reference value $H_k$.

In order that the balancing operation may be improved, it is necessary to increase a time period required for the speed of the drum 7 to pass a speed range in which the centrifugal force acting on laundry in the drum 7 is approximate to the gravity. When the speed of the drum 7 is increased from zero to the upper reference speed $N_a$ as in the initial processing in the first embodiment, the aforesaid speed range is limited to that in the vicinity of the upper reference speed $N_a$.

On the other hand, when the rotational speed is gradually decreased as in the second embodiment, the aforesaid speed range is approximately between the upper and lower reference speeds $N_a$ and $N_b$. Consequently, the time period of the balancing operation can be rendered longer and accordingly, the balancing effect can further be improved.

Third Embodiment

FIGS. 10 to 15 illustrate a third embodiment of the invention. In the third embodiment, the d-axis current in the vector control is also used for the purpose of estimating the laundry weight.

Figure 14:
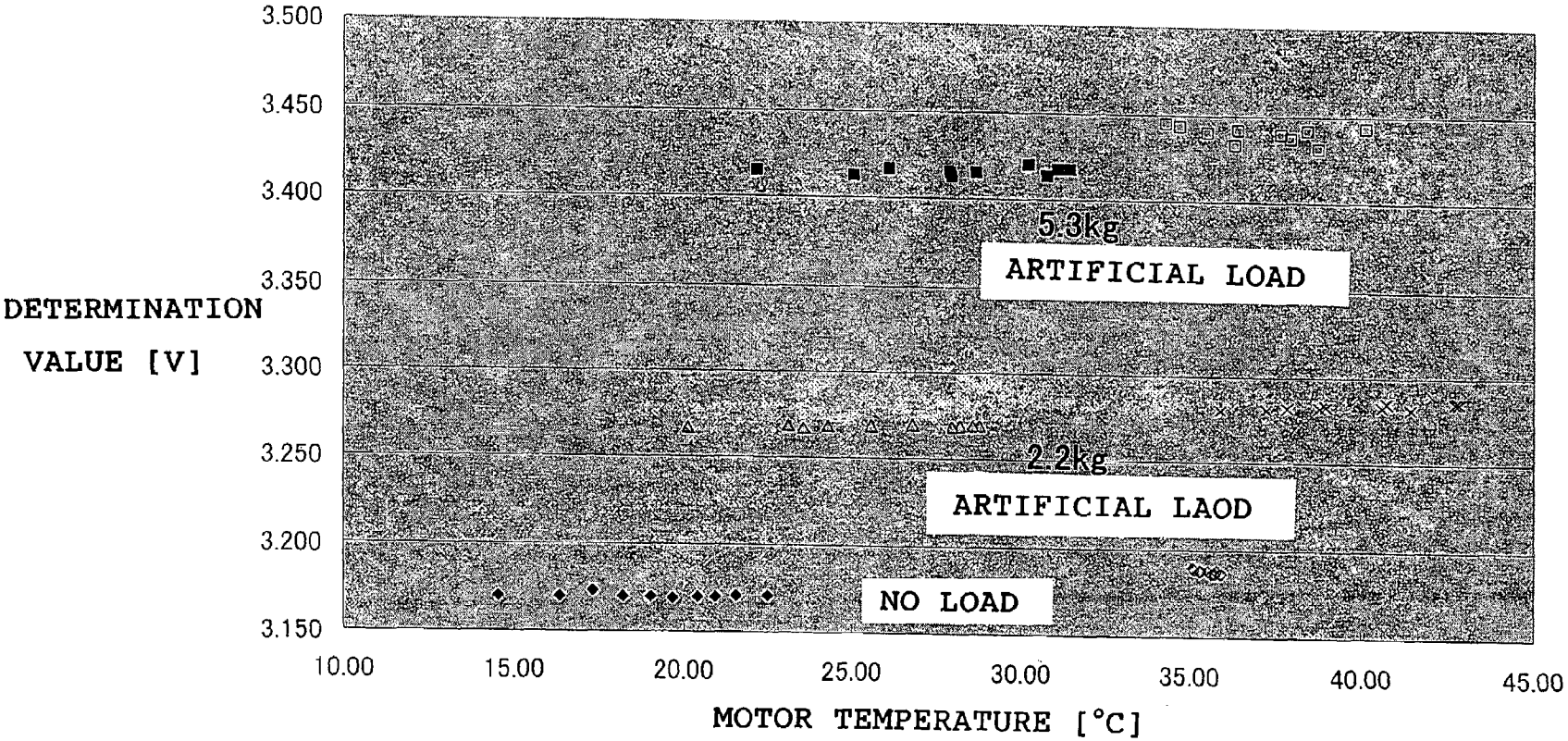
FIG. 14 is a graph showing determined values measured in the case where the drum is rotated while the motor temperature and the load are changed.

Firstly, the principles of the estimation will be described with reference to FIGS. 14 and 15. FIG. 14 is a graph on which are plotted determination values measured when the temperature of the motor 14 (mainly the winding temperature) is changed and the drum 17 is rotated under no load condition, the condition of a 2.2 kg artificial load, and the condition of a 5.3 kg artificial load. Regarding each condition, measured points are divided into two groups. The lower temperature side group indicates the case where the room temperature is at 14° C., whereas the higher temperature side group indicates the case where the room temperature is at 26° C. FIG. 14 shows that a determination value tends to become larger under the same load condition as the temperature of the motor 14 rises. This is based on the fact that a resistance value of the motor winding varies with changes in the temperature. More specifically, when the washing machine is operated and the motor 14 is energized, the temperature of the motor winding rises. The resistance value of the motor winding varies with changes in the winding temperature. The variations in the resistance value of the winding affect the q-axis current to be detected.

Figure 15:
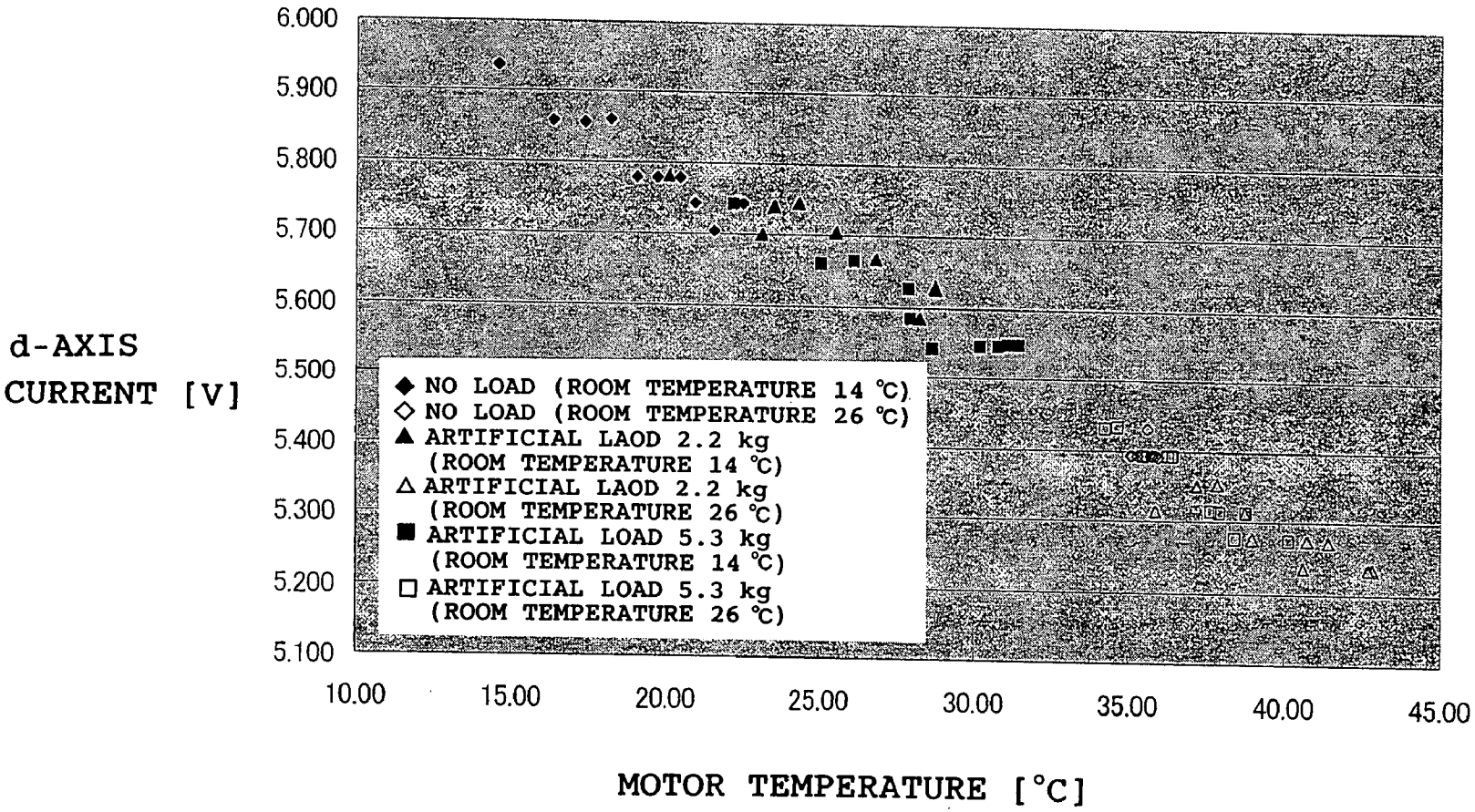
FIG. 15 is a graph showing d-axis current values detected when the motor temperature is changed and the motor is rotated under the same load conditions as in FIG. 14.

FIG. 15 shows d-axis current values detected when the motor temperature is changed and the motor 14 is rotated under the same load conditions as in FIG. 14. Since the d-axis current is an exciting current component of the motor 14, the current value tends to change linearly according to the variations in the winding resistance. More specifically, even when the temperature of the motor 14 changes, the laundry weight can be shown as a function of the q-axis and d-axis currents. The inventors then assumed that y was a function of the following equation (19 when y was the laundry weight, x was an effective value of the q-axis current, and z was an effective value of the d-axis current (see FIG. 12):

$$y=a\cdot x^2+b\cdot x+c\cdot z^2+d\cdot z+e \quad (1)$$

A known laundry weight y was given to the equation so that the q-axis and d-axis currents x and z were measured. Coefficients (a, b, c, d and e) were obtained from data sequence of (y, x, z) using the multidimensional least square. The following result was obtained, for example:

$$a=-13.70780694$$

$$b=112.5122816$$

$$c=-242.8221477 \quad (2)$$

$$d=-0.5916270169$$

$$e=7.546078222$$

Estimating the laundry weight on the basis of these results corresponds to compensating the laundry weight estimated on the basis of only the q-axis current, according to the estimated motor winding temperature.

Figure 10:
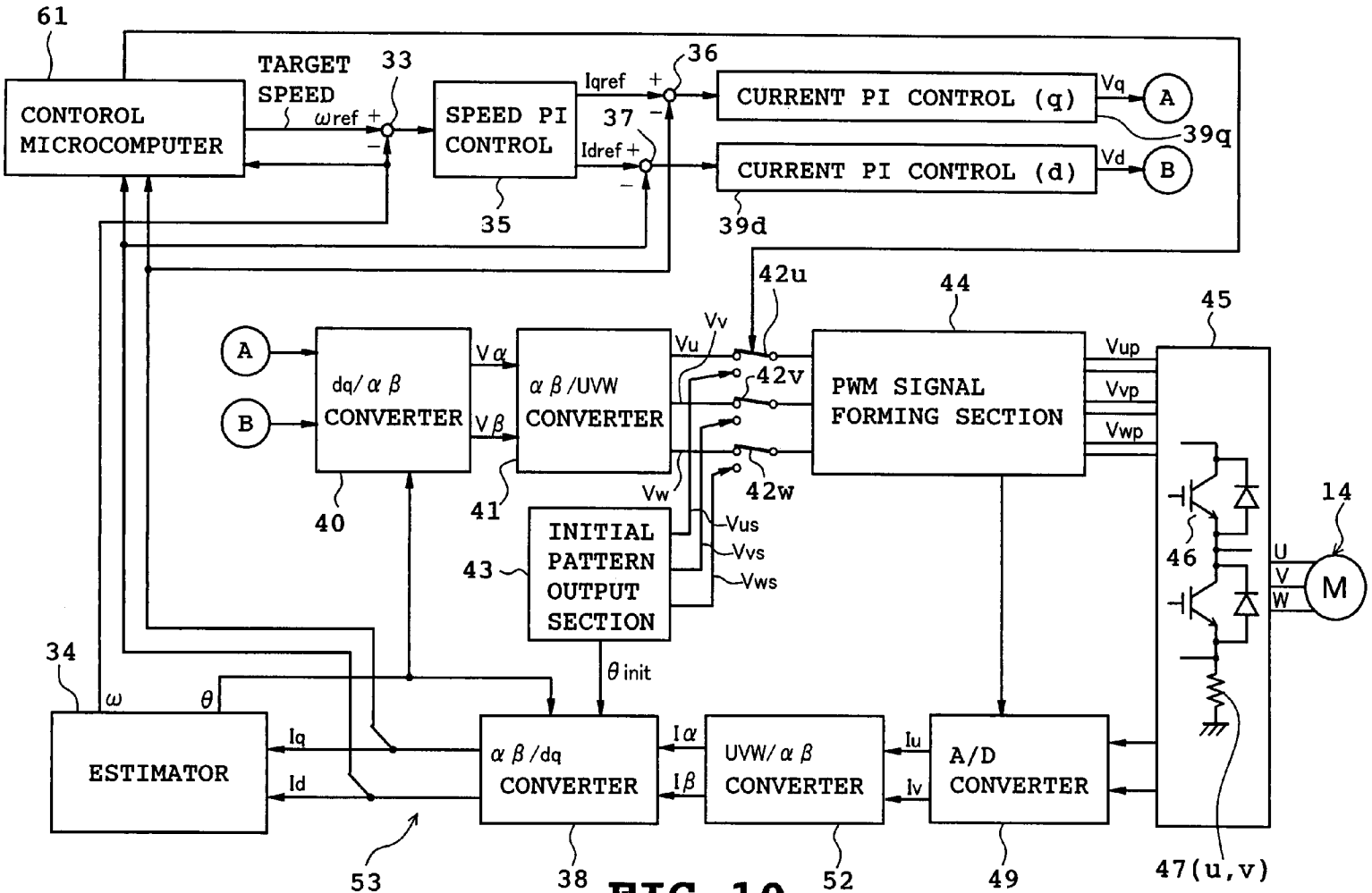
FIG. 10 is a view similar to FIG. 1, showing a third embodiment.
Figure 11:
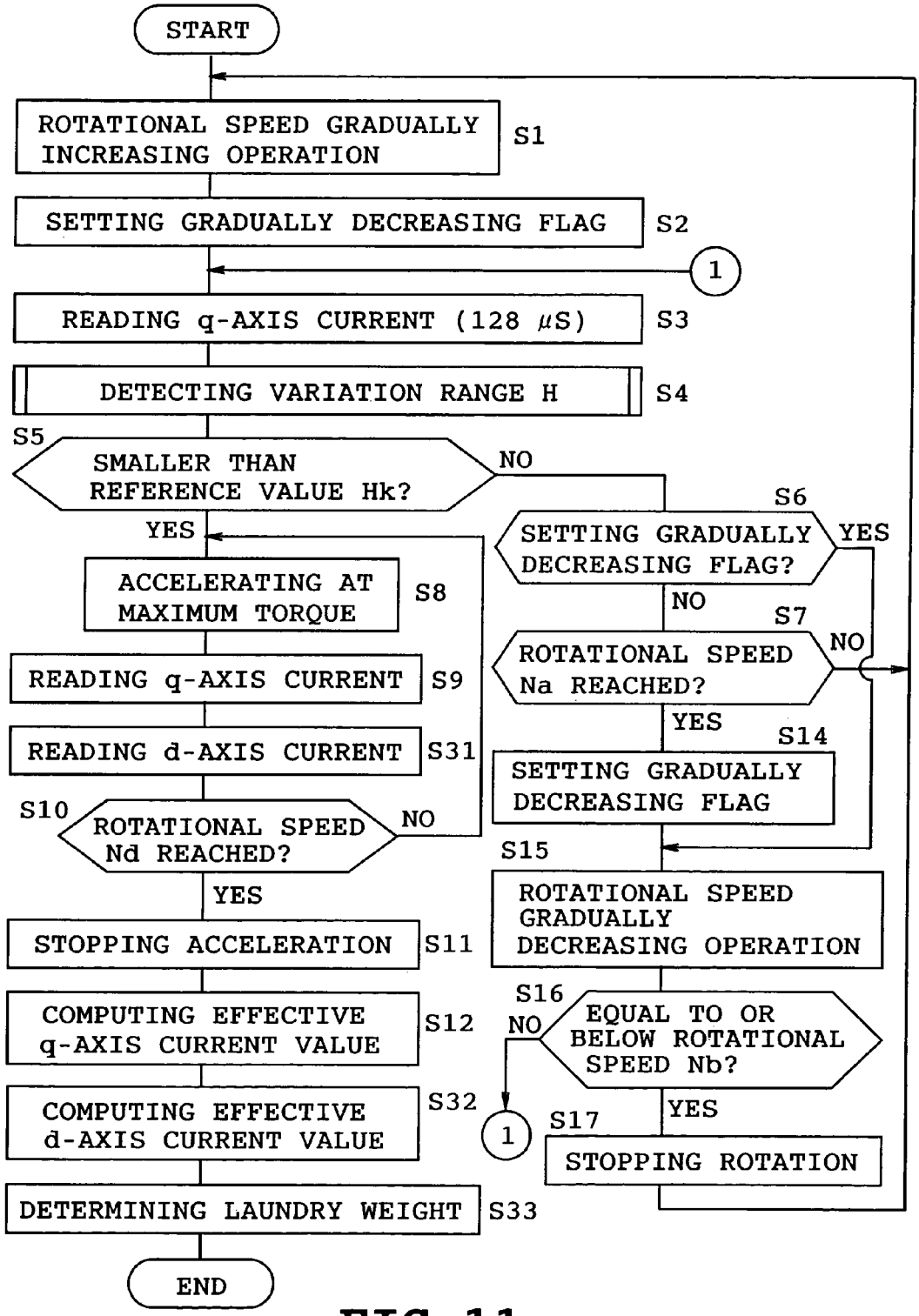
FIG. 11 is a view similar to FIG. 3, showing the third embodiment.
Figure 12:
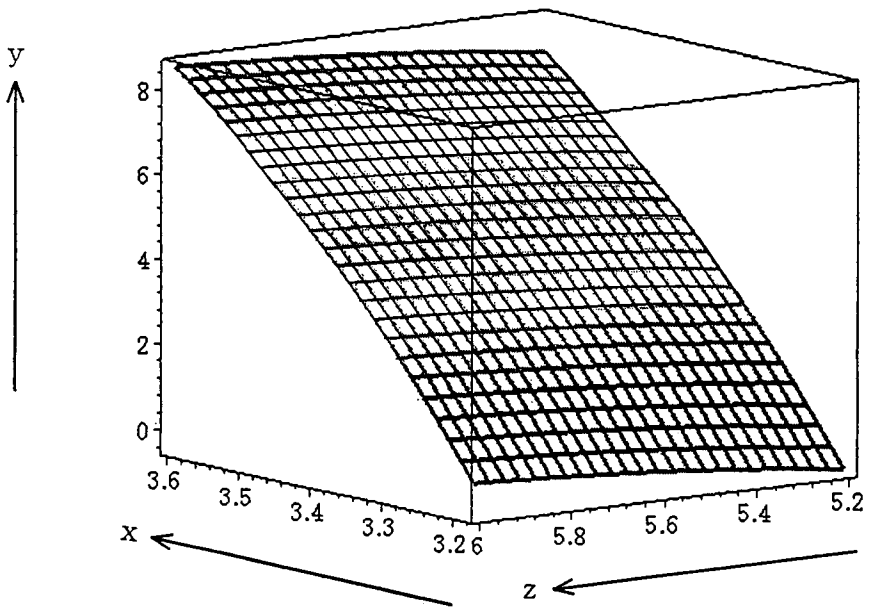
FIG. 12 shows equation (1) as a three-dimensional concept.

In the block diagram of FIG. 10, the control microcomputer (the temperature detector and laundry weight estimator) 61 is arranged so as to read the d-axis current values $I_d$ delivered by the estimator 34 as well as the q-axis current values $I_q$. In the flowchart of FIG. 11, the control microcomputer 54 reads the q-axis current at step S9 and then the d-axis current at step S31. The control microcomputer 54 computes the effective value of the q-axis current at step S12 and then the effective value of the d-axis current at step S32. Subsequently, the numerals (2) are substituted for the coefficients (a, b, c, d and e) so that the laundry weight is determined (step S33).

Figure 13A:
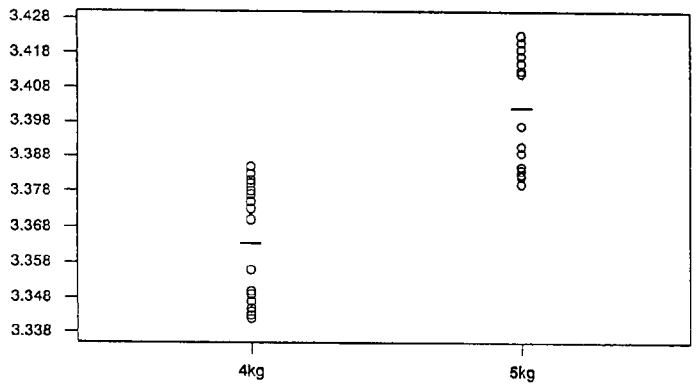
FIGS. 13A and 13B show a case where laundry weight is estimated on the basis of only the q-axis current and a case where laundry weight is estimated with temperature compensation by d-axis current, respectively.
Figure 13B:
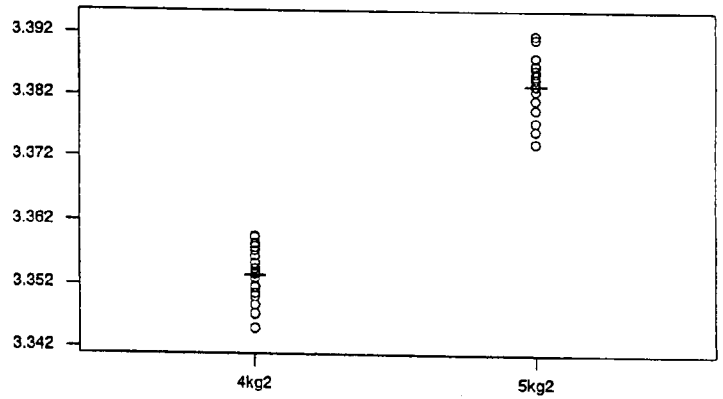

FIG. 13A shows a case where the laundry weight is estimated on the basis of only the q-axis current as in the first embodiment, whereas FIG. 13B shows a case where temperature compensation is carried out on the basis of the d-axis current and the laundry weight is estimated on the basis of the compensated temperature as in the third embodiment. In FIG. 13A, an axis of ordinates represents an effective value of the q-axis current in the case where the load is at 4 kg and 5 kg. In FIG. 13B, an axis of ordinates represents y computed on the basis of equation (1).

When the load is at 4 kg and 5 kg, the standard deviation σ is 0.0167 and 0.0165 in FIG. 13A respectively, whereas the standard deviation σ is 0.004 in each case in FIG. 13B. Namely, 3σ is 0.005 in FIG. 13A and 0.0012 in FIG. 13B. Accordingly, a variation amounts to a one fourth or below, whereupon the measuring accuracy can be improved exceedingly.

In the third embodiment, the control microcomputer 61 estimates the winding temperature of the motor 14 on the basis of the d-axis current value in the vector control and compensates the estimated laundry weight on the basis of the winding temperature. Consequently, the estimation accuracy can further be improved. Furthermore, since the d-axis current is an exciting current component of the motor 14, the resistance value of the motor winding can be estimated when the d-axis current is referred to. Consequently, the compensation can be made on the winding temperature without provision of a temperature sensor or the like.

Several modified forms of the foregoing embodiments will be described. In the first embodiment, steps S2 to S6 and S14 to S17 may be eliminated. The determination may be made at step S7 subsequently to execution of step S3. When determining in the affirmative (YES at step S7), the control microcomputer 54 may advance to step S8. In other words, the control microcomputer 54 may determine that laundry in the drum 7 is balanced to some degree, based on only the fact that the speed of the drum 7 has reached the upper reference value.

In the second embodiment, too, steps S22 and S23 may be eliminated and the determination may be made at step S16 subsequently to execution of step S22. When determining in the affirmative (YES at step S16), the control microcomputer 54 may advance to step S8.

In the third embodiment, the temperature detector may or may not be based on the d-axis current. When the temperature detector is not based on the d-axis current, a temperature sensor may be provided to detect the winding temperature directly and the laundry weight estimated in the manner of the first embodiment may be compensated on the basis of the directly detected winding temperature.

INDUSTRIAL APPLICABILITY

According to the present invention, a drum washing machine can be provided which can estimate an amount of laundry with high accuracy under the condition where the distribution balance of laundry in a drum is rendered uniform to some degree.

The invention claimed is:

1. A drum washing machine comprising:

a cylindrical drum including a front portion formed with an access opening through which laundry is put thereinto, the drum having a substantially horizontal axis of rotation;

a DC brushless motor having a rotational shaft directly connected to a rear of the drum, thereby rotating the drum;

current detecting means for detecting an electric current flowing through the motor;

torque control means for vector-controlling the motor based on the current detected by the current detecting means, so that torque developed by the motor becomes optimum at least in a wash operation and a dehydration operation; and laundry weight estimating means for accelerating the motor with a maximum output torque, which is developed when determining that a rotational speed of the motor is between a first rotational speed at which the laundry is assumed to start falling from an uppermost part of an inner periphery of the drum when as the rotational speed of the motor is reduced from a high speed side and a second rotational speed at which the laundry in the drum is assumed to start sticking to an uppermost part of the inner periphery of the drum, thereby estimating a laundry weight according to a q-axis current value in the vector control during an accelerating period.

2. The drum washing machine according to claim 1, wherein the laundry weight estimating means carries out a balancing control in which the laundry weight estimating means detects variations in the q-axis current value in the vector control when the rotational speed of the motor is between the first and second rotational speeds, the laundry weight estimating means starting acceleration of the motor when a variation level is reduced to or below a predetermined value.

3. The drum washing machine according to claim 2, wherein the laundry weight estimating means carries out the balancing control until the rotational speed of the drum once increased is thereafter decreased to the first rotational speed.

4. The drum washing machine according to claim 3, wherein the laundry weight estimating means carries out the balancing control based on an effective value of the q-axis current.

5. The drum washing machine according to claim 3, further comprising temeperature detecting means for detecting a winding temperature of the motor, wherein the laundry weight estimating means compensates a result of estimation of laundry weight based on the detected winding temperature.

6. The drum washing machine according to claim 5, wherein the temperature detecting means estimates the winding temperature of the motor based on a d-axis current value in the vector control.

7. The drum washing machine according to claim 2, wherein the laundry weight estimating means carries out the balancing control until the rotational speed of the drum increased from zero reaches the second rotational speed.

8. The drum washing machine according to claim 7, further comprising temperature detecting means for detecting a winding temperature of the motor, wherein the laundry weight estimating means compensates a result of estimation of laundry weight based on the detected winding temperature.

9. The drum washing machine according to claim 8, wherein the temperature detecting means estimates the winding temperature of the motor based on a d-axis current value in the vector control.

10. The drum washing machine according to claim 7, wherein the the laundry weight estimating means carries out the balancing control based on an effective value of the q-axis current.

11. The drum washing machine according to claim 2, wherein the laundry weight estimating means carries out the balancing control on the basis of an effective value of the q-axis current.

12. The drum washing machine according to claim 11, further comprising temperature detecting means for detecting a winding temperature of the motor, wherein the laundry weight estimating means compensates a result of estimation of laundry weight based on the detected winding temperature.

13. The drum washing machine according to claim 12, wherein the temperature detecting means estimates the winding temperature of the motor based on a d-axis current value in the vector control.

14. The drum washing machine according to claim 2, further comprising temperature detecting means for detecting a winding temperature of the motor, wherein the laundry wight estimating means compensates a result of estimation of alundry weight based on the detected winding temperature.

15. The drum washing machine according to claim 14, wherein the temperature detecting means estimates the winding temperature of the motor based on a d-axis current value in the vector control.

16. The drum washing machine according to claim 1, further comprising temperature detecting means for detecting a winding temperature of the motor, wherein the laundry weight estimating means compensates a result of estimation of laundry weight based on the detected winding temperature.

17. The drum washing machine according to claim 16, wherein the temperature detecting means estimates the winding temperature of the motor based on a d-axis current value in the vector control.

* * * * *